US005390593A

United States Patent [19]

Gustavsson

[11] Patent Number: 5,390,593

[45] Date of Patent: Feb. 21, 1995

[54] WASTE COMPACTOR INCLUDING GAS SPRING EJECTOR MECHANISM

[75] Inventor: Kenneth Gustavsson, Sävsjö, Sweden

[73] Assignee: AB Orwak, Säsjö, Sweden

[21] Appl. No.: 175,400

[22] PCT Filed: Jun. 25, 1992

[86] PCT No.: PCT/SE92/00468

§ 371 Date: Jan. 7, 1994

§ 102(e) Date: Jan. 7, 1994

[87] PCT Pub. No.: WO93/01046

PCT Pub. Date: Jan. 21, 1993

[30] Foreign Application Priority Data

Jul. 9, 1991 [SE] Sweden ..... 9102148

[51] Int. Cl.[6] ..... B30B 15/32

[52] U.S. Cl. ..... 100/218; 100/255

[58] Field of Search ..... 100/53, 218, 226, 255

[56] References Cited

U.S. PATENT DOCUMENTS

| | | | |
|---|---|---|---|
| 2,236,609 | 1/1881 | Miller | 100/218 |
| 3,659,427 | 5/1972 | Harza | 100/53 X |
| 3,851,577 | 12/1974 | Newcom et al. | 100/218 |
| 3,916,781 | 11/1975 | Cerniglia | 100/218 X |
| 4,057,009 | 11/1977 | Burford et al. | 100/218 X |
| 4,232,599 | 11/1980 | Ulrich | 100/218 X |

FOREIGN PATENT DOCUMENTS

| | | | |
|---|---|---|---|
| 514521 | 2/1955 | Italy | 100/218 |
| 154476 | 6/1963 | U.S.S.R. | 100/218 |
| 573379 | 9/1977 | U.S.S.R. | 100/218 |

*Primary Examiner*—Stephen F. Gerrity

*Attorney, Agent, or Firm*—Burns, Doane, Swecker & Mathis

[57] ABSTRACT

A waste compactor comprises a waste container (1) which has a first opening (4) provided for the introduction of waste, and a second opening (5) closed by an openable door (8) and provided for the discharge of waste. Through the first opening (4), a press plate (3) can be inserted in the container (1) in order to compact waste therein. A discharging device (18) is provided in the container (1) for discharging compacted waste through the second opening (5). A spring assembly (9) is connected to the discharging device (18) so as to cause, when tripped, this device to discharge compacted waste. A tensioning device (14) projecting into the container (1) is adapted to cooperate with the press plate (3) so as to tension the spring assembly (9) when the plate is inserted in the container (1). A tripping device (23) is provided for tripping the spring assembly when the door (8) is open.

8 Claims, 3 Drawing Sheets

WASTE COMPACTOR INCLUDING GAS SPRING EJECTOR MECHANISM

Figure 1:
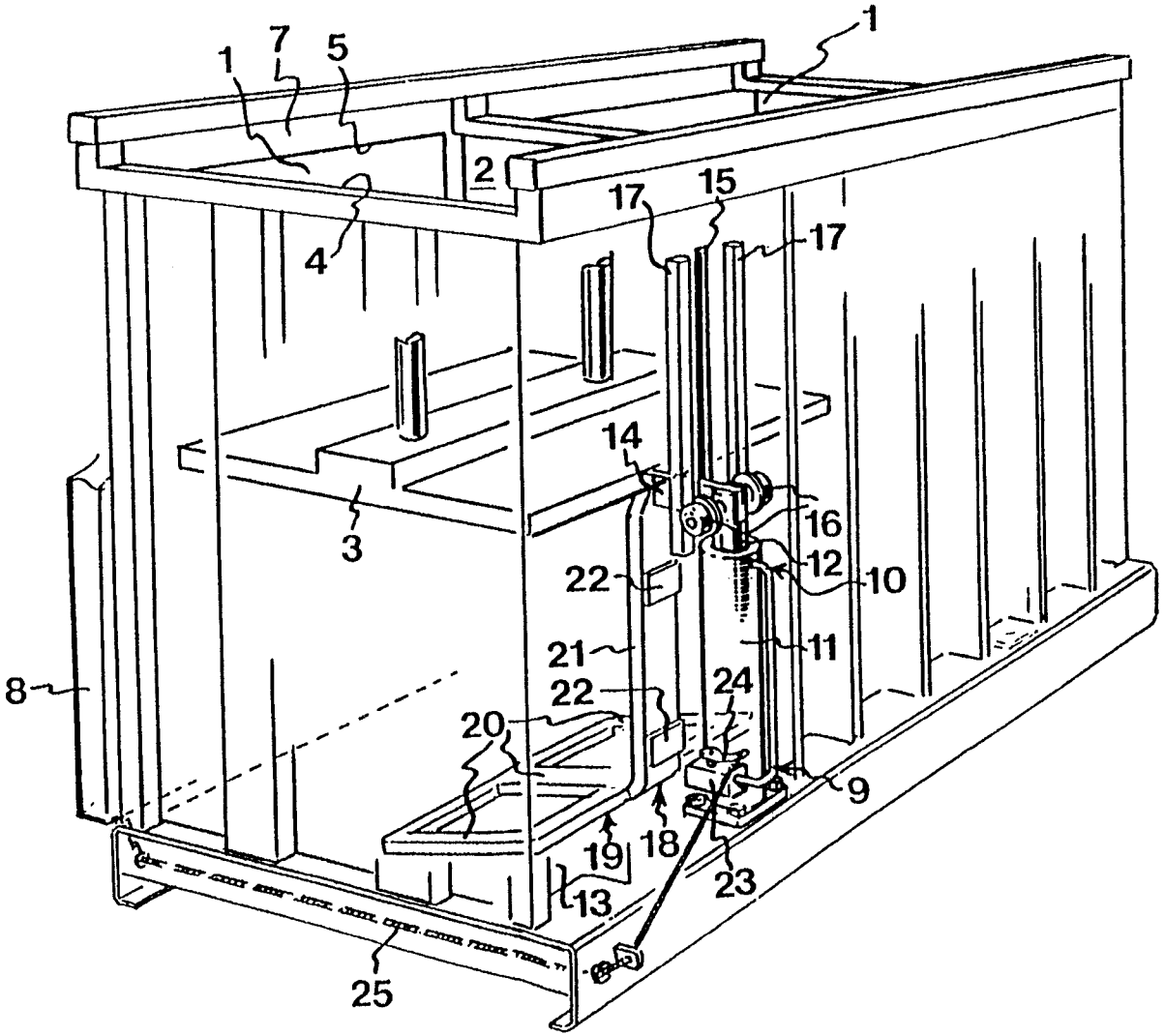

The present invention relates to a waste compactor comprising a waste container which has a first opening provided for the introduction of waste, and a second opening closed by an openable door and provided for the discharge of waste; a press unit comprising a press plate insertable in the container through the first opening and adapted to compact waste in the container; and a discharging device disposed in the container and adapted to discharge compacted waste through the second opening.

A prior-art waste compactor of this type, used as a baling press for compacting paper waste, comprises two juxtaposed waste containers separated by a partition. A discharging device is provided in each container. Further, in each container, the first opening is provided in the upper wall and the second opening is provided in the front wall. The baling press comprises a hydraulic press unit which is horizontally displaceable between a first position, in which the press plate is located straight above one container, and a second position, in which the press plate is located straight above the other container. In both positions, the press plate can perform a compacting stroke, during which it is lowered into the container to compact the paper waste placed therein. The discharging device of each container is provided with tipping arms extending from the rear portion of the container barely halfway into the container along the bottom thereof. At their rear portion, the tipping arms are connected to a substantially vertical operating rod adapted to raise the rear portion of the tipping arms to tip a bale of compacted paper waste resting on the arms. The operating rod has a hook at its upper end and is pivotally arranged in a slot in the rear wall of the container. When a finished paper bale rests on the tipping arms and the press plate is in its lower end position, the operating rod is pivoted by its own weight in such a manner that its hook-equipped, upper end is introduced into the container through the slot in the rear wall. When the press plate is moved upwards from its lower end position after the door has been opened, it will engage the hook of the operating rod and entrain the operating rod upwards a certain distance, and consequently also the rear portion of the tipping arms, such that the paper bale is thus tipped through the front opening.

An inconvenience of this prior-art baling press is that the operating rod is sometimes jammed by paper waste stuck in the slot provided for the rod in the rear wall of the container. If so, the hook of the operating rod will not be introduced in the container, and the paper bale is thus not tipped when the press plate is moved upwards. Then, the stuck paper waste has to be removed, whereupon the door is closed, the press plate is made to perform another compacting stroke down to its lower end position so that the operating rod can be pivoted in order to introduce the hook in the container, the door is opened, and the press plate is again moved upwards so as to engage the hook and tip the paper bale.

In the prior-art baling press described above, use is made of electric switches which, for safety reasons, are adapted to permit the press plate to perform compacting strokes only when the door is closed. However, the operators have been found to disconnect the safety functions occasionally in order to save time, by manipulating the switches to enable the press plate to perform compacting strokes also when the door is open. In doing so, the operators put themselves in unacceptable peril.

An effort has been made to master this safety problem by providing the press unit of the baling press with a solid safety plate designed to prevent the press unit from being moved to a position in which the press plate is located straight above one of the containers, should the container door be imperfectly shut. This solution does not, however, obviate the risk of the operating rod being jammed and the ensuing delay in the tipping of the paper bale.

The object of the present invention is, therefore, to provide a waste compactor obviating this inconvenience.

According to the invention, this object is achieved by a waste compactor which is of the type stated by way of introduction and which is characterised by a spring assembly which is connected to the discharging device so as to cause, when tripped, this device to discharge compacted waste; a tensioning device projecting into the container and adapted to cooperate with the press plate so as to tension the spring assembly when said plate is inserted in the container; and a tripping device adapted to trip the spring assembly when the door is open.

Suitably, the tripping device is connected to the door by a cable.

In a preferred embodiment, the spring assembly includes a gas spring. Conveniently, the gas spring is disposed outside the container, and the tensioning device suitably consists of a driver arm connected to the piston rod of the gas spring and projecting into the container through a slot in the container wall, the driver arm being situated, when the gas spring is not tensioned, in the path of movement of the press plate so as to tension the gas spring during the compacting stroke of the press plate by being entrained by the press plate to the end position of the compacting stroke.

In a waste compactor where the first opening is provided in the upper container wall and the second opening is provided in the front container wall, the gas spring is conveniently vertically disposed behind the container, the discharging device being connected to the piston rod of the gas spring by the driver arm and having at least one discharging arm which extends barely halfway into the container from the rear portion thereof and which, when the driver arm is in the end position of the compacting stroke and the gas spring thus is tensioned, extends along the bottom of the container.

Figure 2:
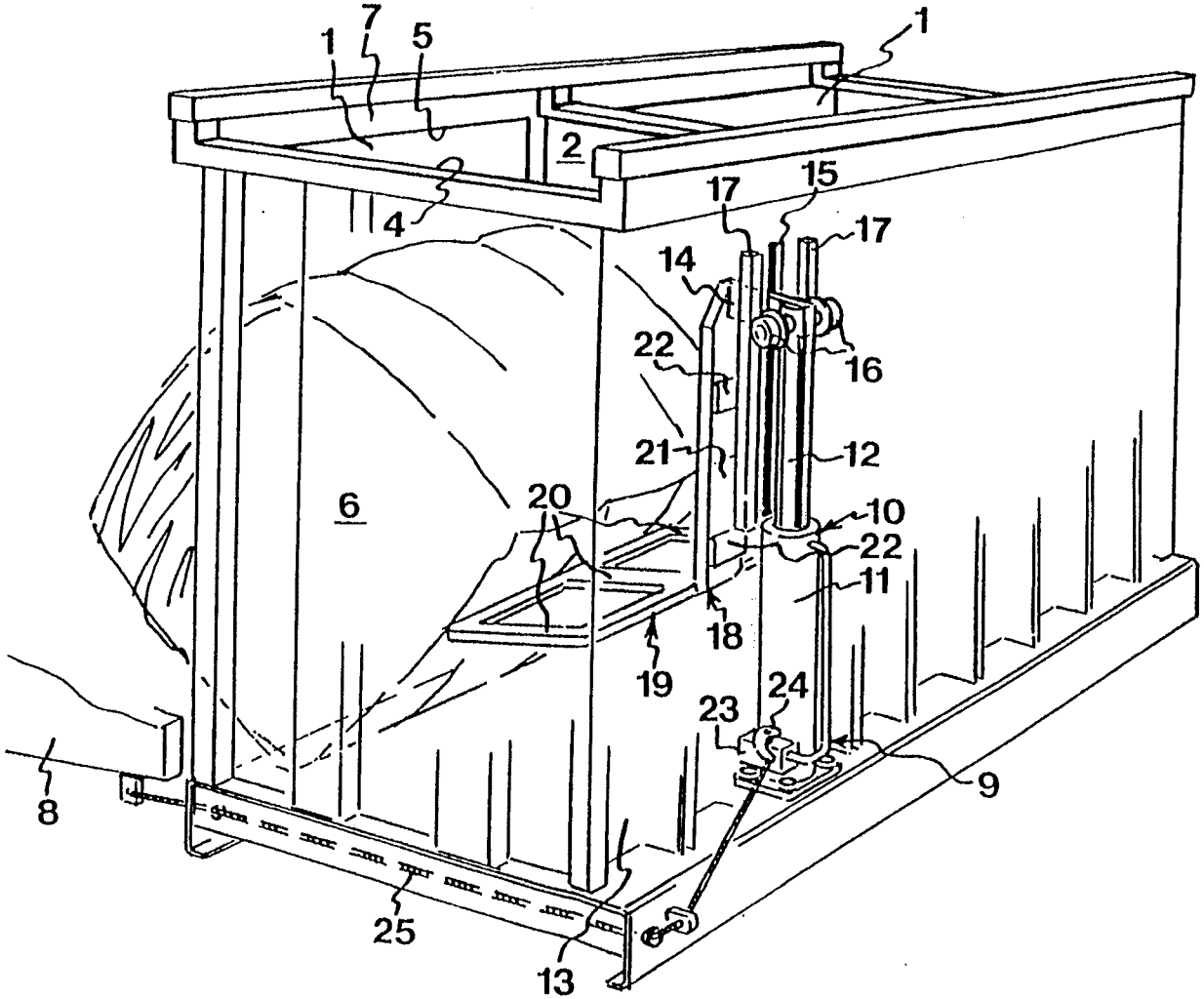
Figure 3:
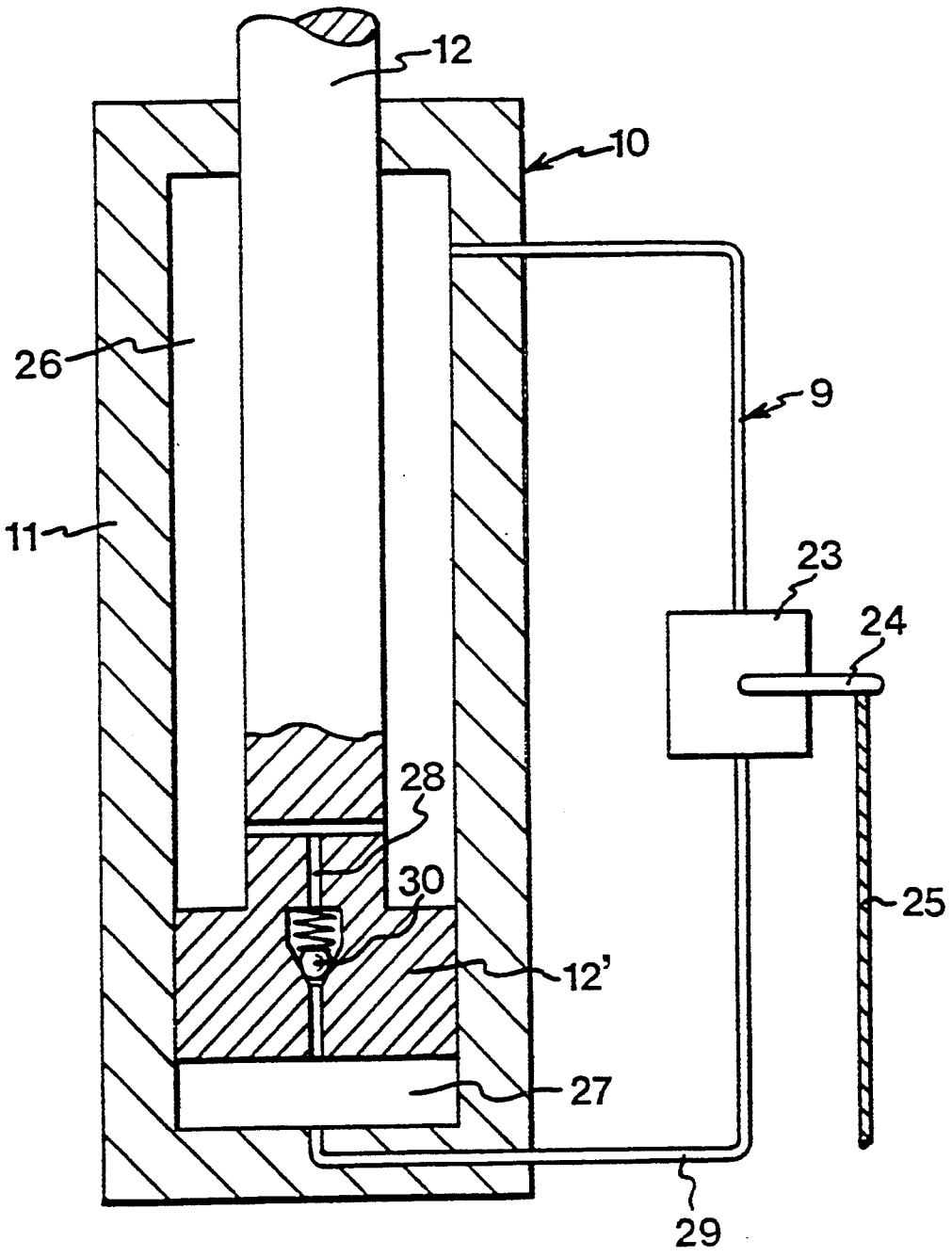

A preferred embodiment of the invention will be described below with reference to the accompanying drawings, in which FIG. 1 is a schematic perspective view showing a waste compactor according to the invention with a tensioned spring assembly, FIG. 2 is a schematic perspective view showing the waste compactor of FIG. 1 with a tripped spring assembly, and FIG. 3 is a partly sectional view schematically illustrating the spring assembly.

The illustrated waste compactor is a baling press for compacting and baling paper waste and plastic waste. The baling press comprises two juxtaposed waste containers 1 which are separated by a partition 2. The farther container in the drawings is intended for plastic waste, while the nearer container is intended for paper waste. A hydraulic press unit (not shown) comprising a press plate 3 can be horizontally displaced between a first position, in which the press plate 3 is located straight above the paper-waste container, and a second position, in which the press plate 3 is located straight above the plastic-waste container.

The two waste containers 1 are identical, and the invention will in the following be described further with reference to the paper-waste container which is illustrated in more detail in the drawings.

The container 1 has an upper opening 4 for introducing paper waste. In the front wall 7, the container 1 has an opening 5 for discharging baled paper waste 6. The discharging opening 5 can be closed by a door 8 which is pivotable about a vertical axis between a closed position (FIG. 1) and an open position (FIG. 2).

When the press unit is in the first position, the press plate 3 may perform a compacting stroke, during which it moves through the supply opening 4 down into the container 1 in order to compact the paper waste placed therein. The press plate 3 is vertically displaceable between an upper position, in which it is located above the containers 1, such that the press unit can be horizontally displaced between the two containers, and a lower compacting position.

A spring assembly 9, including a vertically disposed gas spring 10 with a cylinder 11, a piston 12' (FIG. 3) and a piston rod 12, is mounted outside the rear wall 13 of the container 1. The spring assembly 9 is tensioned by the piston rod 12 of the gas spring 10 being pushed into the gas-spring cylinder 11 from an upwardly extended position (FIG. 2).

At its free end, the piston rod 12 of the gas spring 10 is connected to a driver arm 14 projecting into the container 1 through a vertical slot 15 formed in the rear container wall 13. When the piston rod 12 is in its extended position, the driver arm 14 extends into the path of movement of the press plate 3 (see FIG. 1). At its free end, the piston rod 12 of the gas spring 10 also carries two supporting rollers 16 which roll along two vertical guide members 17 secured to the outside of the rear wall 13 on both sides of the slot 15.

A discharging device 18, which is provided in the container 1 for discharging baled paper waste 6 through the front opening 5, has a horizontal fork portion 19 with three forwardly-directed prongs 20, and a vertical connecting portion 21 which, at its lower end, is rigidly connected to the fork portion 19 and, at its upper end, is rigidly connected to the driver arm 14. The prongs 20 extend barely halfway into the container 1 from the rear portion thereof. At its rear side, the connecting portion 21 has two sliding blocks 22 resting on the inside of the rear wall 13.

The spring assembly 9 comprises a tripping mechanism 23 operated by a rocker arm 24 which is spring-loaded towards a first position (FIG. 1) and which is connected to the door 8 by a wire 25. This wire is so connected to the door 8 that, when the door is opened, it moves the rocker arm 24 to a tripping position (FIG. 2), in which the mechanism 23 trips the spring assembly 9. Then, the piston rod 12 of the gas spring 10 is moved to its extended position. When the door 8 is being closed, the rocker arm 24 is returned by the spring load to its first position.

In the initial position of the baling press, the piston rod 12 of the gas spring 10 is in its extended position, in which it holds the discharging device 18 in a raised tipping position (FIG. 2). After the door 8 has been closed, the press plate 3 is moved down into the container 1 so as to engage the driver arm 14 projecting into its path of movement and so as to press this arm downwards. Thus, the piston rod 12 is pushed into the cylinder 11, such that the spring assembly 9 is tensioned, and the discharging device 18 is moved to a lower position, in which the fork portion 19 is located at the bottom of the container 1. Then, the press plate 3 is returned to its upper position, whereupon the press unit is moved to its second position, uncovering the opening 4 of the container 1. Paper waste is introduced into the container 1 and is compacted now and then by the press unit being moved to its first position and the press plate 3 being made to perform a compacting stroke. When a bale 6 of compacted paper waste ready for tying up has been obtained, it is tied up in a known manner not to be described in more detail here, whereupon the press plate 3 is moved to its upper position. When the paper bale 6 has been tied up and is ready to be tipped, the door 8 is opened and the spring assembly 9 is tripped so that the piston rod 12 of the gas spring 10 is extended and thus moves the discharging device 18 to its raised tipping position. Then, the fork portion 19 tips the paper bale 6 through the front opening 5, as illustrated in FIG. 2. Now, the baling press again occupies its initial position.

The spring assembly 9 is schematically illustrated in FIG. 3. The cylinder 11 of the gas spring 10 is divided by the piston 12' into an upper return chamber 26 and a lower working chamber 27 which contain nitrogen gas. The two chambers 26 and 27 communicate with one another both via a channel 28 passing from the working chamber 27 through the piston 12' and opening in the return chamber 26 via the piston rod 12, and via a conduit 29 passing between the chambers 26 and 27 outside the cylinder 11. A non-return valve 30 permitting gas flow from the working chamber 27 to the return chamber 26 is provided in the channel 28. The above-mentioned tripping mechanism 23 is disposed in the conduit 29 and consists of a valve which is closed when the rocker arm 24 is in its first position (FIGS. 1 and 3), towards which it is spring-loaded, and open when the rocker arm 24 is in its tripping position (FIG. 2), to which it is pulled by the wire 25 when the door 8 is opened.

As the press plate 3 pushes the piston rod 12 into the cylinder 11 when the valve 23 is closed, gas from the working chamber 27 flows to the return chamber 26 via the channel 28 and the non-return valve 30 provided therein. After the press plate 3 has been returned to its upper position, the piston rod 12 is retained in its retracted position by the gas pressure built up in the return chamber 26, as long as the valve 23 is closed. When the door 8 is opened, the rocker arm 24 opens the valve 23, and gas flows from the return chamber 26 to the working chamber 27 via the conduit 29 and the valve 23 provided therein, which is now open. The piston 12' is thus pressed upwards and moves the piston rod 12 to its extended position (FIG. 1).

I claim:

1. A waste compactor comprising a waste container (1) which has a first opening (4) provided for the introduction of waste, and a second opening (5) closed by an openable door (8) and provided for the discharge of waste; a press unit comprising a press plate (3) insertable in the container through the first opening (4) and adapted to compact waste in the container; and a discharging device (18) disposed in the container (1) and adapted to discharge compacted waste (6) through the second opening (5), characterised by a spring assembly (9) which is connected to the discharging device (18) so as to cause, when tripped, this device to discharge compacted waste (6); a tensioning device (14) projecting into the container (1) and adapted to cooperate with the press plate (3) so as to tension the spring assembly (9) when said plate is inserted in the container (1); and a tripping device (23) adapted to trip the spring assembly when the door (8) is open.

2. A waste compactor as set forth in claim 1, characterised in that the tripping device (23) is connected to the door (8) by a cable (25).

3. A waste compactor as set forth in claim 2, characterised in that the spring assembly (9) includes a gas spring (10).

4. A waste compactor as set forth in claim 6, characterised in that the gas spring (10) is disposed outside the container (1), and that the tensioning device consists of a driver arm (14) connected to the piston rod (12) of the gas spring (10) and projecting into the container (1) through a slot (15) in the container wall (13), the driver arm (14) being situated, when the gas spring (10) is not tensioned, in the path of movement of the press plate (3) so as to tension the gas spring during the compacting stroke of the press plate by being entrained by the press plate to the end position of the compacting stroke.

5. A waste compactor as set forth in claim 4, in which the first opening (4) is provided in the upper wall of the container (1), and the second opening (5) is provided in the front wall (7) of the container (1), characterised in that the gas spring (10) is vertically disposed behind the container, and that the discharging device (18) is connected to the piston rod (12) of the gas spring (10) by the driver arm (14) and has at least one discharging arm (20) which extends barely halfway into the container (1) from the rear portion thereof and which, when the driver arm (14) is in the end position of the compacting stroke and the gas spring (10) thus is tensioned, extends along the bottom of the container (1).

6. A waste compactor as set forth in claim 1 characterised in that the spring assembly (9) includes a gas spring (10).

7. A waste compactor as set forth in claim 6, characterised in that the gas spring (10) is disposed outside the container (1), and that the tensioning device consists of a driver arm (14) connected to the piston rod (12) of the gas spring (10) and projecting into the container (1) through a slot (15) in the container wall (13), the driver arm (14) being situated, when the gas spring (10) is not tensioned, in the path of movement of the press plate (3) so as to tension the gas spring during the compacting stroke of the press plate by being entrained by the press plate to the end position of the compacting stroke.

8. A waste compactor as set forth in claim 7, in which the first opening (4) is provided in the upper wall of the container (1), and the second opening (5) is provided in the front wall (7) of the container (1), characterised in that the gas spring (10) is vertically disposed behind the container, and that the discharging device (18) is connected to the piston rod (12) of the gas spring (10) by the driver arm (14) and has at least one discharging arm (20) which extends barely halfway into the container (1) from the rear portion thereof and which, when the driver arm (14) is in the end position of the compacting stroke and the gas spring (10) thus is tensioned, extends along the bottom of the container (1).

* * * * *